US008249284B2

(12) United States Patent
Allegro-Baumann et al.

(10) Patent No.: US 8,249,284 B2
(45) Date of Patent: Aug. 21, 2012

(54) HEARING SYSTEM AND METHOD FOR DERIVING INFORMATION ON AN ACOUSTIC SCENE

(75) Inventors: Silvia Allegro-Baumann, Unterägeri (CH); Stefan Launer, Zurich (CH); Hilmar Meier, Zurich (CH); Hans-Ueli Roeck, Hombrechtikon (CH); Herbert Bächler, Meilen (CH)

(73) Assignee: Phonak AG, Stafa (CH)

( * ) Notice: Subject to any disclaimer, the term of this patent is extended or adjusted under 35 U.S.C. 154(b) by 1361 days.

(21) Appl. No.: 11/459,185

(22) Filed: Jul. 21, 2006

(65) Prior Publication Data

US 2007/0269064 A1 Nov. 22, 2007

Related U.S. Application Data

(60) Provisional application No. 60/747,345, filed on May 16, 2006.

(51) Int. Cl.
*H04R 5/02* (2006.01)
*H04R 25/00* (2006.01)

(52) U.S. Cl. ..... 381/309; 381/313

(58) Field of Classification Search ..... 381/309, 381/312, 314, 313, 317, 74, 23.1, 26
See application file for complete search history.

(56) References Cited

U.S. PATENT DOCUMENTS

| | | | | |
|---|---|---|---|---|
| 5,473,701 | A | 12/1995 | Cezanne et al. | |
| 7,158,931 | B2 * | 1/2007 | Allegro | 704/225 |
| 7,209,568 | B2 * | 4/2007 | Arndt et al. | 381/313 |
| 7,457,426 | B2 * | 11/2008 | Drtina | 381/313 |
| 7,657,047 | B2 * | 2/2010 | Fischer | 381/314 |
| 7,680,291 | B2 * | 3/2010 | Frieding | 381/314 |
| 2004/0175008 | A1 * | 9/2004 | Roeck et al. | 381/312 |
| 2006/0176587 | A1 | 8/2006 | Homme | |
| 2006/0233353 | A1 * | 10/2006 | Beaucoup et al. | 379/406.01 |
| 2007/0160242 | A1 * | 7/2007 | Cadalli et al. | 381/312 |

FOREIGN PATENT DOCUMENTS

| | | | |
|---|---|---|---|
| EP | 0326905 | A1 | 8/1989 |
| EP | 0732036 | B1 | 9/1996 |
| EP | 1326478 | A3 | 9/2003 |
| EP | 1670285 | A2 | 6/2006 |

(Continued)

OTHER PUBLICATIONS

European Search Report dated Apr. 30, 2003 in reference to European application No. EP03005179.

(Continued)

*Primary Examiner* — Hai Phan
(74) *Attorney, Agent, or Firm* — Pearne & Gordon LLP

(57) ABSTRACT

The invention relates to a method for operating a hearing system comprising an input unit, an output unit and a transmission unit operationally interconnecting said input output units. Said transmission unit implements a transfer function describing, how audio signals generated by said input unit are processed in order to derive audio signals fed to said output unit, and can be adjusted by one or more transfer function parameters. Said method comprises obtaining, by means of said input unit and with a first directional characteristic, first audio signals from incoming acoustic sound; deriving from said first audio signals a first set of sound-characterizing data; and deriving, in dependence of first directional information, which is data comprising information on said first directional characteristic, and of said first set of sound-characterizing data, a value for each of said one or more transfer function parameters. This allows to gain insight into the acoustic environment and allows for better automatic adjustments of said transfer function.

26 Claims, 7 Drawing Sheets

FOREIGN PATENT DOCUMENTS

| | | | |
|---|---|---|---|
| WO | 9515668 | A1 | 6/1995 |
| WO | 99/09786 | A1 | 2/1999 |
| WO | 9943185 | A1 | 8/1999 |
| WO | 0068703 | A2 | 11/2000 |
| WO | 01/20965 | A3 | 3/2001 |
| WO | 01/22790 | A3 | 4/2001 |
| WO | 01/60112 | A3 | 8/2001 |
| WO | 02/32208 | A3 | 4/2002 |
| WO | 2005-029914 | A1 | 3/2005 |
| WO | 00/68703 | A3 | 11/2300 |

OTHER PUBLICATIONS

European Search Report dated Apr. 12, 2007 for application No. 06015269.

Kates, James M. "Classification of Background Noises for Hearing-Aid Applications" (1995, Journal of Acoustical society of America 97 (1), pp. 461-469.

Edwards, Brent W. et al. "Signal-processing algorithms for anew software-based, digital hearing device" (1998, The Hearing Journal 51, pp. 44, 46, 47, 50, 52).

Hirsch, Herbert L. "Statistical Signal Characterization," pp. 24-35 (Artech House 1992).

Ostendorf, M. et al. "Classification of Acoustic signals Based on the Analysis of Modulation Spectra of Application in Digital Hearing Aids" (1998, DAGA 98, pp. 402-403). Concise explanation of relevance is found on application p. 12, lines 3-12.

Ostendorf, M. "Empirical Classification of Different Acoustic Signals and Speech by Means of a Modulation-Frequency Analysis" (1997, DAGA 97, pp. 608-609). Concise explanation of relevance is found on application p. 12, lines 3-12.

* cited by examiner

HEARING SYSTEM AND METHOD FOR DERIVING INFORMATION ON AN ACOUSTIC SCENE

TECHNICAL FIELD

The invention relates to a hearing system and a method for operating a hearing system, and to a method for deriving information on an acoustic scene and the application of that method in a hearing system. The invention furthermore relates to a method for manufacturing signals to be perceived by a user of the hearing system. The hearing system comprises at least one hearing device. Under a "hearing device", a device is understood, which is worn adjacent to or in an individual's ear with the object to improve individual's acoustical perception. Such improvement may also be barring acoustical signals from being perceived in the sense of hearing protection for the individual. If the hearing device is tailored so as to improve the perception of a hearing impaired individual towards hearing perception of a "standard" individual, then we speak of a hearing-aid device. With respect to the application area a hearing device may be applied behind the ear, in the ear, completely in the ear canal or may be implanted. In case of a hearing system comprising two hearing devices, monaural and binaural hearing systems are considered.

BACKGROUND OF THE INVENTION

One example of a hearing device is a hearing-aid device. Modern hearing-aid devices, when employing different hearing programs (typically two to four hearing programs, also termed audiophonic programs), permit their adaptation to varying acoustic environments or scenes. The idea is to optimize the effectiveness of the hearing-aid device for the hearing-aid device user in all situations.

The hearing program can be selected either via a remote control or by means of a selector switch on the hearing-aid device itself. For many users, however, having to switch program settings is a nuisance, or it is difficult, or even impossible. It is also not always easy, even for experienced users of hearing-aid devices, to determine, at what point in time which hearing program is suited best and offers optimum speech intelligibility. An automatic recognition of the acoustic scene and a corresponding automatic switching of the program setting in the hearing-aid device is therefore desirable.

The switch from one hearing program to another can also be considered a change in a transfer function of the hearing device, wherein the transfer function describes signal processing within the hearing system. The transfer function may depend on one or more parameters, also referred to as transfer function parameters, and may then be adjusted by assigning values to said parameters.

There exist several different approaches to the automatic classification of acoustic surroundings. Typically, the methods concerned involve the extraction of different characteristics from an input signal. Based on the so-derived characteristics, a pattern-recognition unit employing a particular algorithm makes a determination as to the attribution of the analyzed signal to a specific acoustic environment.

As examples for classification methods and their application in hearing systems, the following publications shall be named: WO 01/20965 A2, WO 01/22790 A2 and WO 02/32208 A2.

Furthermore, EP 1 670 285 A2, published on Jun. 14, 2006, shall be mentioned, which discloses a training mode for classifiers in hearing devices. It is disclosed that in said training mode, a sound source can be separated by narrow beamforming. This will isolate the targeted source and, as far as said training mode is on, the classifier will be trained for the targeted source, while other sources of sound are suppressed by said narrow beam-forming. The training provides the classifier with considerable amounts of data on the class represented by the targeted source. This way, an improved reliability of the classification can be achieved.

Not in all situations, hearing program change based on the classification result provides for an optimum hearing sensation for the user. It would be desirable to provide for an improved basis for choosing a hearing program to switch to and/or for the point in time when to switch hearing programs.

SUMMARY OF THE INVENTION

One object of the invention is to create a hearing system, a method of operating a hearing system, a method for deriving information on an acoustic scene, and method for manufacturing signals to be perceived by a user of the hearing system, which allow for an improved performance, in particular, for an improved automatic adaptation (of a hearing system) to an acoustic environment.

Another object of the invention is to provide for an improved basis for deciding about changes in an adjustable transfer function of the hearing system.

Another object of the invention is to more comprehensively recognize acoustic scenes.

Another object of the invention is to increase the probability that sources of sound are correctly recognized.

Another object of the invention is to provide for a more precise determination of an acoustic scene.

Further objects emerge from the description and embodiments below.

At least one of these objects is at least partially achieved by the methods and apparatuses according to the patent claims.

The method for operating a hearing system comprising an input unit, an output unit and a transmission unit operationally interconnecting said input unit and said output unit, said transmission unit implementing a transfer function which describes, how audio signals generated by said input unit are processed in order to derive audio signals fed to said output unit, and which can be adjusted by one or more transfer function parameters, comprises the steps of a1) obtaining, by means of said input unit and with a first directional characteristic of said input unit, first audio signals from incoming acoustic sound;

b1) deriving from said first audio signals a first set of sound-characterizing data;

c) deriving, in dependence of
- first directional information, which is data comprising information on said first directional characteristic, and of
- said first set of sound-characterizing data,
- a value for each of at least one of said transfer function parameters.

The hearing system comprises
- an input unit for obtaining, with a first directional characteristic of said input unit, incoming acoustic sound and deriving therefrom first audio signals;
- an output unit for receiving output audio signals and transducing these into signals to be perceived by a user of the hearing system;
- a transmission unit, which is operationally interconnecting said input unit and said output unit, and which implements a transfer function, which can be adjusted by one or more transfer function parameters and which describes, how audio signals generated by said input unit are processed in order to derive said output audio signals;

a characterizing unit for deriving from said first audio signals a first set of sound-characterizing data;

an evaluating unit for deriving, in dependence of said first set of sound-characterizing data and of first directional information, which is data comprising information on said first directional characteristic, a value for each of at least one of said transfer function parameters.

The method for deriving information on an acoustic scene comprises the steps of p1) obtaining, with a first directional characteristic, first audio signals from incoming acoustic sound from said acoustic scene;

p2) obtaining, with a second directional characteristic, which is different from said first directional characteristic, second audio signals from incoming acoustic sound from said acoustic scene;

q1) deriving from said first audio signals a first set of sound-characterizing data;

q2) deriving from said second audio signals a second set of sound-characterizing data;

r) deriving said information on said acoustic scene in dependence of first directional information, which is data comprising information on said first directional characteristic, said first set of sound-characterizing data, second directional information, which is data comprising information on said second directional characteristic, and of said second set of sound-characterizing data.

The invention also comprises the use of said method for deriving information on an acoustic scene in a hearing system.

The method for manufacturing signals to be perceived by a user of a hearing system comprising an input unit, an output unit and a transmission unit operationally interconnecting said input unit and said output unit, said transmission unit implementing a transfer function which describes, how audio signals generated by said input unit are processed in order to derive audio signals fed to said output unit, and which can be adjusted by one or more transfer function parameters, comprises the steps of s) obtaining, by means of said input unit and with a first directional characteristic of said input unit, first audio signals from incoming acoustic sound;

t) deriving from said first audio signals a first set of sound-characterizing data;

u) deriving, in dependence of first directional information, which is data comprising information on said first directional characteristic, and of said first set of sound-characterizing data, a value for each of at least one of said transfer function parameters;

v) obtaining output audio signals by processing audio signals generated by said input unit according to said transfer function using said derived value or values;

w) transducing said output audio signals into said signals to be perceived by a user of the hearing system.

It has been found out, that the merit of information obtained by characterizing picked-up acoustic sound, e.g., by means of a classification, can be tremendously increased when that information is linked to directional information. Instead of just recognizing, that certain sources of sound are (somewhere) present, it can be detected, where certain kinds of sources of sound are located. Such information is most valuable when the hearing system shall automatically adjust its transfer function to the acoustic environment in which the hearing system user is currently located in.

The invention provides for a link (or for an improved link) between the result of a sound characterization and a direction in space.

The link between the information on which kind of sounds are present, or, more general, the sound-characterizing data, and the directional information is realized by evaluating the sound-characterizing data together with data comprising information on the directional characteristic. Directional characteristics are typically described in form of polar patterns.

The invention provides for an improved way for evaluating the acoustic environment. Sound characteristics can be assigned to the direction of arrival of the sound.

Under audio signals, electrical signals, analogue and/or digital, are understood, which represent sound.

The transfer function of a hearing system describes, how input audio signals are processed in order to derive output audio signals. Therein, input audio signals are audio signals derived, by means of said input unit, from incoming acoustic sound and fed to said transmission unit, and output audio signals are audio signals which are fed (from said transmission unit) to said output unit and which are to be transduced into signals to be perceived by a user of the hearing system.

The transfer function may comprise filtering, dynamics processing, phase shifting, pitch shifting, noise cancelling, beam steering and various other functions. This is known in the art, in particular in the field of hearing-aid devices. The transfer function may depend, e.g., on time, frequency, direction of sound, amplitude. Numerous parameters on which the transfer function may depend (also referred to as "transfer function parameters") can be thought of, like parameters depicting frequencies, e.g., filter cutoff frequencies or knee point levels for dynamics processing, or parameters depicting loudness values or gain values, or parameters depicting the status or functions of units like noise cancellers, beam formers, locators, or a parameter simply indicating a pre-stored hearing program.

Said input unit usually comprises at least one input transducer.

An input transducer typically is a mechanical-to-electrical converter, in particular a microphone. It transduces acoustic sound into audio signals.

Said output unit usually comprises at least one output transducer.

An output transducer can be an electrical-to-electrical or electrical-to-mechanical converter and typically is a loudspeaker, also referred to as receiver.

The term "acoustic sound" is used in order to indicate that sound in the acoustic sense, i.e., acoustic waves, is meant.

Said set of sound-characterizing data may be just one number or datum, e.g., a signal-to-noise ratio or a signal pressure level in a certain frequency range, but typically comprises several numbers or data. In particular, it may comprise classification results. The sound-characterizing data can be indicative of an acoustic scene.

Classification (classifying methods, possible features to classify, classes and so on) will be described only roughly here. More details on classification may, e.g., be taken from the above-mentioned publications WO 01/20965 A2, WO 01/22790 A2 and WO 02/32208 A2 and references therein. These publications are therefore herewith incorporated by reference in this application.

Features that can be extracted from audio signals as sound-characterizing data or as features for a classification are described in the above-mentioned publications WO 01/20965 A2, WO 01/22790 A2 and WO 02/32208 A2 and can be, e.g., auditory-based characteristics (e.g., loudness, spectral shape, harmonic structure, common build-up and decay processes, coherent amplitude modulations, coherent frequency modulations, coherent frequency transitions and binaural effects), or more technical characteristics (e.g., signal-to-noise ratio, spectral center of gravity, level): For the extraction of features (characteristics) in audio signals, J. M. Kates in his article titled "Classification of Background Noises for Hearing-Aid Applications" (1995, Journal of the Acoustical Society of America 97(1), pp 461-469), suggested an analysis of time-related sound-level fluctuations and of the sound spectrum. On its part, the European patent EP-B1-0 732 036 proposed an analysis of the amplitude histogram for obtaining the same result. Finally, the extraction of features has been investigated and implemented based on an analysis of different modulation frequencies. In this connection, reference is made to the two papers by Ostendorf et al titled "Empirical Classification of Different Acoustic Signals and of Speech by Means of a Modulation-Frequency Analysis" (1997, DAGA 97, pp 608-609), and "Classification of Acoustic Signals Based on the Analysis of Modulation Spectra for Application in Digital Hearing Aids" (1998, DAGA 98, pp 402-403). A similar approach is described in an article by Edwards et al titled "Signal-processing algorithms for a new software-based, digital hearing device" (1998, The Hearing Journal 51, pp 44-52). Other possible characteristics include the sound-level transmission itself or the zero-passage rate as described for instance in the article by H. L. Hirsch, titled "Statistical Signal Characterization" (Artech House 1992).

For the classification of sets of features various methods and algorithms can be used. E.g., Hidden Markov Models, Fuzzy Logic, Bayes' Classifier, Rule-based Classifier Neuronal Networks, Minimal Distance and others.

The set of possible classes according to which the sets of features can be classified may, e.g., comprise acoustic-scene-describing classes, like, e.g., "speech", "noise", "speech in noise", "music" and/or others.

The term "directional characteristic" as used in the present application is understood as a characteristic of amplification or sensivity in dependence of the direction of arrival of the incoming acoustic sound. Under "direction of arrival", the direction is understood, in which an acoustical source (also referred to as source of sound or sound source) "sees" the center of the user's head. We define angles of direction of arrival in a counter-clockwise (mathematically positive) sense relative to the ahead-direction in the sagittal plane of user's head, seen from top to bottom.

Said directional characteristic with which, by means of said input unit, said audio signals are obtained from said incoming acoustic sound typically depends on the polar pattern of the employed transducers (microphones) and on the processing of the so-derived raw audio signals. Also, so-called head-related transfer functions (HRTFs) may be considered, in particular their part describing the head shadow, i.e., the direction-dependent damping of sound due to the fact that a hearing device of the hearing system is worn in or near the user's ear. The HRTFs may be averaged HRTFs or individually measured.

Said derived value or values for the transfer function parameters can be considered to form a set of values. That set of values may be just said set of sound-characterizing data and said directional information, in which case the evaluation unit merely passes on the data it received; or it may comprise other data derived therefrom, in particular, it may be data indicating at least one direction (typically representing a polar angle or a range of polar angles) and data indicating an estimate about the kind of source of sound located in said direction; or it may be just a number indicating which hearing program to choose.

Said signals to be perceived by a user of the hearing system may be acoustic sound or, e.g., in the case of a hearing system comprising an implanted hearing device, an electrical and/or mechanical signal or others.

Said transmission unit may be realized in form of a signal processor, in particular in form of a digital signal processor (DSP). It shall be noted, that various of the mentioned units of the hearing system may, fully or in part, be integrally realized with each other. E.g., said DSP may embody said transmission unit, said characterizing unit, said evaluating unit, a beam former unit, a beam former controller, a localizer, a feature extractor and a classifier, or part of these. It is to be noted that the various units are described or drawn separately or together merely for reasons of clarity, but they may be realized in a different arrangement; this applies, in particular, also to the examples and embodiments described below.

In one embodiment, a beam former unit is provided. A beam former unit, also referred to as "beam former", is capable of beam forming. We understand under "beam-forming" (also referred to as "technical beam-forming") tailoring the amplification of an electrical signal (also referred to as "audio signals") with respect to an acoustical signal (also referred to as "acoustical sound") as a function of direction of arrival of the acoustical signal relative to a predetermined spatial direction. Customarily, the beam characteristic is represented in form of a polar diagram, scaled in dB.

Beam formers are known in the art. One type of beam formers receives audio signals from at least two spaced-apart transducers (typically microphones), which convert incoming acoustic sound into said audio signals, and processes these audio signals, typically by delaying the one audio signals with respect to the other audio signals and adding or subtracting the result. By means of this processing, new audio signals are derived, which are, with a new, tailored directional characteristic, obtained from said incoming acoustic sound. Typically, said tailored directional characteristic is tailored such, that acoustic sound originating from a certain direction (typically characterized by a certain polar angle or polar angle range) is either preferred with respect to acoustic sound originating from other directions, or suppressed with respect to acoustic sound originating from other directions.

For further reference on beam formers, it is referred to US 2002/0176587 A1, WO 99/09786 A1, U.S. Pat. No. 5,473,701 and WO 01/60112 A2 and references therein. Therefore, these publications are herewith incorporated by reference in this application.

In one embodiment, a localizer is provided. Localizers are known in the art. They receive audio signals from at least two spaced-apart transducers (microphones) and process the audio signals such that, for major sources of sound, the corresponding directions of arrival of sound are detected. I.e., by means of a localizer, the directions, from which certain acoustic signals originate, can be determined; sound sources can be localized, at least directionally.

For further reference on localizers, it is referred to WO 00/68703 A2 and EP 1326478 A2. Therefore, these publications are herewith incorporated by reference in this application.

The output of the localizer, also referred to as "localizing data", may be used for controlling (steering) a beam former.

In one embodiment, the at least one input transducer can, by itself, provide for several different directional characteristics. This may, e.g., be realized by means of a movable (e.g., rotatable) input transducer or by an input transducer with movable (e.g., rotatable) feedings, through which acoustic sound is fed (guided), so that acoustic sound from various directions (with respect to the arrangement of the hearing system or with respect to the user's head) may be suppressed or be preferably transduced.

In one embodiment, which involves feature extraction and classification, the classification is not a "hard" or discrete-mode classification, in which a current acoustic scene (or, more precisely, the corresponding features) would be classified into exactly one of at least two classes, but a "mixed-mode" classification is used, the output of which comprises similarity values indicative of the similarity (likeness) of said current acoustic scene and each acoustic scene represented by each of said at least two classes. A so-obtained similarity vector can be used as a set of values for the transfer function parameters. More details on this type of classification can be taken from the unpublished US provisional application with the application No. U.S. 60/747,330 of the same applicant, filed on May 16, 2006, and titled "Hearing Device and Method of Operating a Hearing Device". Therefore, this unpublished application is herewith incorporated by reference in this application.

In one embodiment of the invention, the method of operating a hearing system furthermore comprises the steps of a2) obtaining, by means of said input unit and with a second directional characteristic of said input unit, which is different from said first directional characteristic, second audio signals from incoming acoustic sound;

b2) deriving from said second audio signals a second set of sound-characterizing data; and wherein step c) is replaced by c') deriving a value for each of at least one of said transfer function parameters in dependence of
- said first directional information,
- said first set of sound-characterizing data,
- said second set of sound-characterizing data, and of
- second directional information, which is data comprising information on said second directional characteristic.

Accordingly, in this embodiment, acoustic sound from the acoustic environment is converted into audio signals at least twice, each time with a different directional characteristic. This may happen successively (i.e., consecutively) or simultaneously. In the latter case, preferably also the processing (deriving of the sound-characterizing data) takes place simultaneously. But the hearing system has to provide for a possibility to simultaneously obtain, with different directional characteristics, audio signals from acoustic sound; this may, e.g., be accomplished by means of at least two input transducers (or at least two sets of input transducers), and/or by realizing two simultaneously-available beam formers. In the case of non-simultaneous, in particular consecutive, obtaining of audio signals with different directional characteristics, the processing (deriving of the sound-characterizing data) for each directional characteristic may well take place consecutively, i.e., processing for one directional characteristic first, and then processing for another directional characteristic. This is slower, but reduces the required processing capacity. This embodiment may even be realized with one single input transducer capable of changing its directional characteristic, or with a single beam former unit, the latter typically being connected to at least two input transducers.

Input transducers of the input unit may be distributed among hearing devices of a hearing system, e.g., the input unit may comprise two (or more) input transducers arranged at each of two hearing devices of a binaural hearing system. E.g., the first directional characteristic may be attributed substantially to the two (or more) input transducers of the left hearing device, and the second directional characteristic may be attributed substantially to the two (or more) input transducers of the right hearing device.

Preferably, said two different directional characteristics are significantly different. It can be advantageous to obtain audio signals from acoustic sound with at least two different directional characteristics, because the information on the acoustic scene, which can be gained that way, is very valuable, since the location of sources of sound can be determined; and the transfer function can be better adapted to the acoustic environment. In particular, it is possible to determine both, the location of sources of sound, and the type of sources of sound.

The advantages of the methods correspond to the advantages of corresponding apparatuses.

Further preferred embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. Generally, alike or alike-functioning parts are given the same or similar reference symbols. The described embodiments are meant as examples and shall not confine the invention.

DETAILED DESCRIPTION OF THE INVENTION

Figure 1:
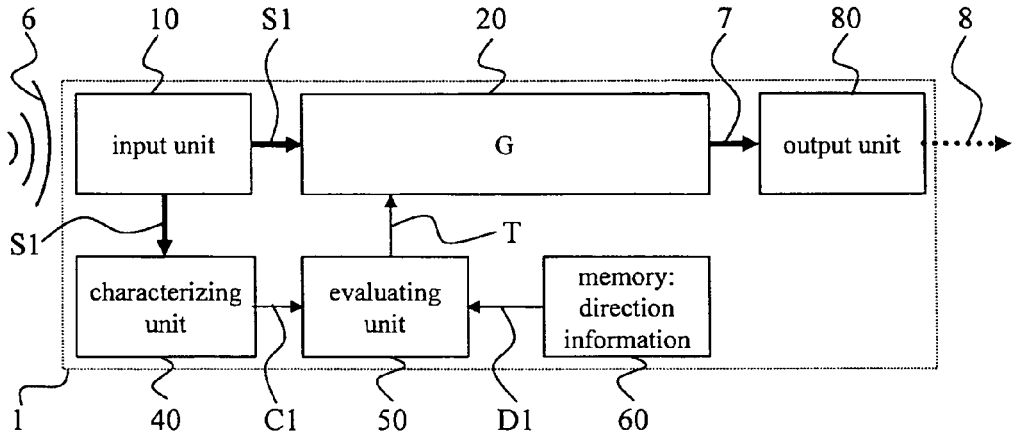
FIG. 1 a block diagram of a hearing system.

FIG. 1 schematically shows a block diagram of a hearing system 1. The hearing system 1 comprises an input unit 10, a transmission unit 20, an output unit 80, a characterizing unit 40, an evaluation unit 50 and a storage unit 60. The input unit 10 is operationally connected to the transmission unit 20, which is operationally connected to the output unit 80, and to the characterizing unit 40, which is operationally connected to the evaluating unit 50. The evaluating unit 50 is operationally connected to the storage unit 60 and to the transmission unit 20.

The input unit 10, e.g., a microphone, receives acoustic sound 6 from the environment and outputs audio signals S1. The audio signals S1 are fed to the transmission unit 20 (e.g., a digital signal processor), which implements (embodies) a transfer function G. The audio signals are processed (amplified, filtered and so on) according to the transfer function G, thus generating output audio signals 7, which are fed to the output unit 80, which may be a loudspeaker. The output unit 80 outputs signals 8 to be perceived by a user of the hearing system 1, which may be acoustic sound (or other signals) derived from the incoming acoustic sound 6.

The audio signals S1 are also fed to the characterizing unit 40, which derives a set C1 of sound-characterizing data therefrom. This set C1 is fed to the evaluating unit 50, and the evaluating unit 50 also receives directional information D1, provided by the storage unit 60.

The evaluating unit 50 derives, in dependence of the set C1 of sound-characterizing data and the directional information D1, a set of values T for parameters of the transfer function, and that set of values T is fed to the transmission unit 20. The transfer function G depends on one or more transfer function parameters. This allows to adjust the transfer function G by assigning different values to at least a part of these transfer function parameters.

In the evaluating unit 50, a link between the audio signals S1 (and, accordingly, the picked-up incoming acoustic sound 6) and the directional information D1 is generated, which is very valuable for assigning such values T to parameters of the transfer function G, which result in an optimized hearing sensation for the user in the current acoustical environment.

The storage unit 60 is optional and may, e.g., be realized in form of some computer memory. The evaluating unit 50 might as well receive the directional information D1 from elsewhere, e.g., from the input unit 10. The directional information D1 is or comprises data related to a directional characteristic, with which the audio signals S1 have been obtained (by means of the input unit 10) from the incoming acoustic sound 6. It may, e.g., comprise data related to a head-related transfer function (HRTF) of the user and/or data related to polar patterns of employed microphones.

In all block-diagrammatical Figures, bold solid arrows depict audio signals, whereas thin solid arrows depict data or control signals.

Figure 2:
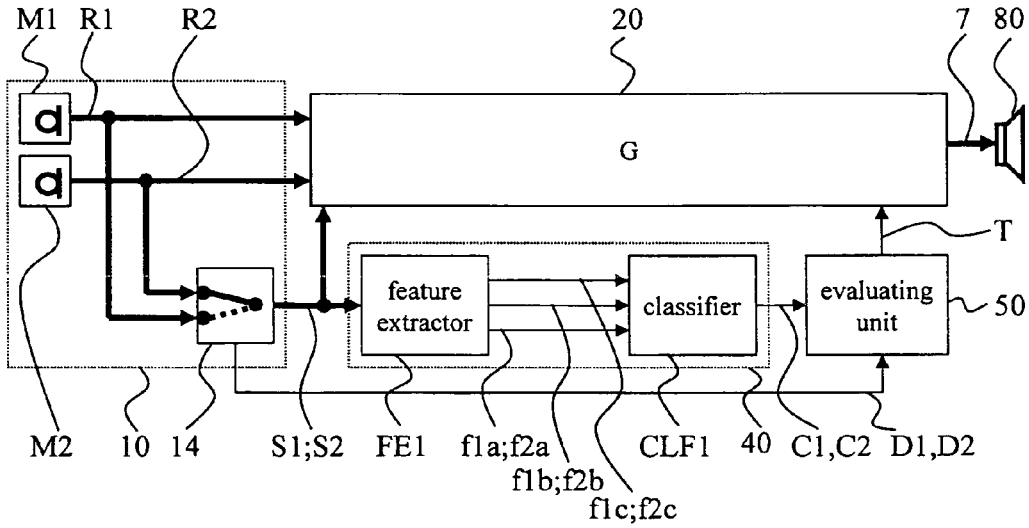
FIG. 2 a block diagram of a hearing system with classification and successive obtaining of audio signals from acoustic sound with different directional characteristics.

FIG. 2 schematically shows a block diagram of a hearing system with classification and successive (consecutive) obtaining, with different directional characteristics, audio signals from acoustic sound. The embodiment is similar to that of FIG. 1, but the input unit 10 and the characterizing unit 40 are depicted in greater detail.

The input unit 10 comprises at least two input transducers M1,M2 (e.g., microphones), which derive raw audio signals R1 and R2, respectively, from incoming acoustic sound (not depicted in FIG. 2). Audio signals obtained by means of input transducers M1 and M2, respectively, are obtained with different directional characteristics: the directional characteristic that can be assigned to input transducer M1 is different from the directional characteristic that can be assigned to input transducer M2. This may be due to differences between the transducers themselves, but may also (at least in part) be due to the location at which the respective transducer is arranged, since this provides for different HRTFs.

As symbolized by switch 14, one of the raw audio signals R1,R2 can be selected as audio signal S1 or S2, respectively, and fed to the characterizing unit 40. I.e., the switch 14 symbolizes or indicates a successive (consecutive) obtaining, with different directional characteristics, of audio signals from acoustic sound. The characterization thereof will then usually take place successively.

It is possible to feed said raw audio signals R1,R2 and/or said audio signal S1 or S2, respectively, to the transmission unit 20.

The characterizing unit 40 comprises a feature extractor FE1 and a classifier CLF1. The feature extractor FE1 extracts features f1*a*,f1*b*,f1*c* from the fed-in audio signal S1, and features f2*a*,f2*b*,f2*c* from the fed-in audio signal S2, respectively. These sets of features, which in general may comprise one, two or more (maybe even of the order of ten or 40) features, are fed to classifier CLF1, in which it is classified into one or a number of several possible classes. The classification result is the sound-characterizing data C1 and C2, respectively, or is comprised therein.

For deriving at least a part of the directional information D1, the evaluating unit 50 is operationally connected to the switch 14. Accordingly, the evaluating unit 50 "knows" whether a currently received set of sound-characterizing data is obtained from acoustic sound picked-up with transducer M1 or with transducer M2. Besides the information, with which the transducers (M1 or M2) acoustic sound has been picked up, the evaluating unit 50 preferably shall also have information about the directional characteristic assigned to the corresponding transducers. Such information (e.g., on HRTFs and polar patterns) may be obtained from the position of switch 14 or from a storage module in the hearing system (not shown).

The embodiment of FIG. 2 may be interpreted to represent, e.g., a hearing device with of a monaural hearing system.

Figure 3:
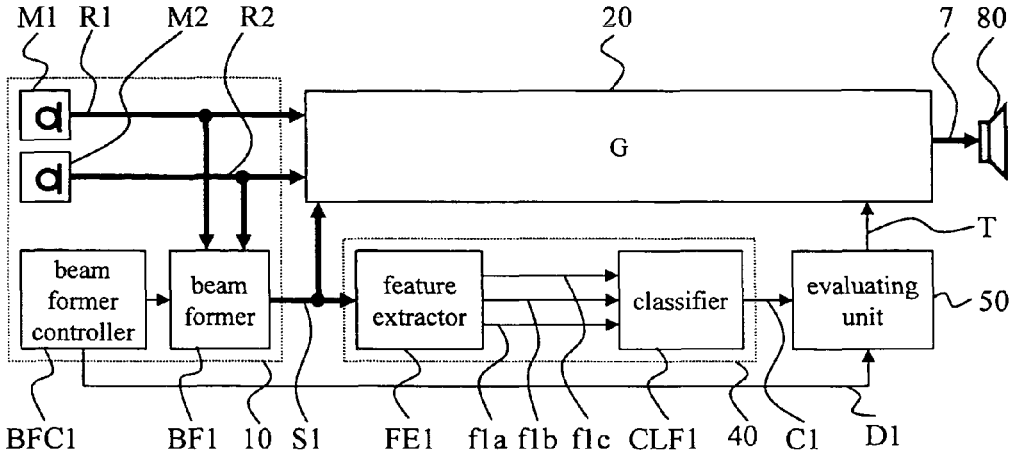
FIG. 3 a block diagram of a hearing system with beam former and classification.

FIG. 3 schematically shows a block diagram of a hearing system 1 with a beam former BF1 and classification. This embodiment is similar to that of FIG. 2, but the input unit 10 comprises a beam former unit BF1 with a beam former controller BFC1, which controls the beam former. The beam former unit BF1 receives raw audio signals R1,R2 and can therefrom derive audio signals S1, wherein these audio signals S1 are obtained with a predetermined, adjustable directional characteristic. This is usually accomplished by delaying said raw audio signals R1,R2 with respect to each other and summing or subtracting the result.

Both raw audio signals R1,R2 will usually be fed also to the transmission unit 20. Additionally or alternatively, said audio signals S1 can be fed to the transmission unit 20, too.

By means of the beam former controller BFC1, the beam former can be adjusted to form a desired directional characteristic, i.e., the directional characteristic is set by means of the beam former. Data related to that desired directional characteristic are at least a part of the directional information D1 and can be transmitted from the beam former controller BFC1 to the evaluation unit 50.

Usually, the beam former will have a preferred direction, i.e., it will be adjusted such that acoustic sound impinging on the transducers M1,M2 from that preferred direction (or angular range) is picked-up with relatively high sensitivity, while acoustic sound from other directions is damped.

It is possible to control the beam former such that only sound from a narrow angular range around the preferred direction is picked up and characterized, and the corresponding sound-characterizing data C1 are then, together with the directional information D1, evaluated, and the transfer function G is thereupon adjusted. Characterization may, e.g., take place by feature extraction and classification.

It is also possible to control the beam former such that first, a first preferred direction (or, more general, a first directional characteristic) is selected, and then a second preferred direction (or, more general, a second directional characteristic) is selected; and optionally after that even more, one after each other. Preferably, a common evaluation of the (at least) two corresponding sets of sound-characterizing data and the corresponding directional information will take place.

Figure 4:
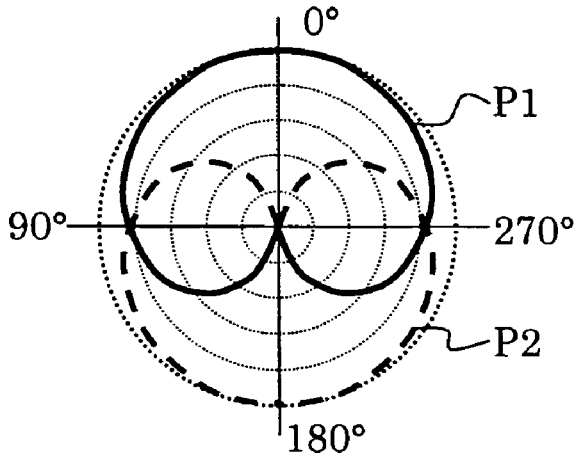
FIG. 4 two directional characteristics (cardioid polar patterns)

In case of two such preferred directions, approximately opposite directions can be chosen. This will usually maximize the information derivable from the common evaluation. For example, the front hemisphere and the back hemisphere can be chosen. FIG. 4 shows an example for that.

FIG. 4 shows schematically two possible exemplary directional characteristics P1 (solid line) and P2 (dashed line) of a microphone arrangement, e.g., like of the two microphones M1,M2 in FIG. 3. The commonly used polar-pattern presentation is chosen; the 0°-direction runs along the hearing system user's nose. When the hearing system is worn by a user, the microphones M1,M2 will usually be on a side of the user's head, so that the (acoustic) head shadow will deform the cardioids of P1,P2 (deformation not shown). This effect can be considered, and accordingly corrected polar patterns P1,P2 can be obtained by making use of a head-related transfer function (HRTF).

The term head-related transfer function (HRTF) in this application comprises, of course, also approximations of HRTFs, and HRTFs reduced to its relevant parts, e.g., parts considering only the amplitude part of the HRTF and leaving out phase information.

The two microphones M1,M2 (or corresponding microphone arrangements) may be worn on the same side of the user's head or on opposite sides.

It is also possible to control the beam former such that the acoustic environment is investigated in four quadrants, preferably with center directions at approximately 0°, 90°, 180°, 270°. This can be accomplished by simultaneously or successively adjusting the beam former such, that sound originating from a location in 0°, 90°, 180° and 270°, respectively, is amplified stronger or attenuated less than sound originating from other locations. The corresponding four sets of sound-characterizing data can, e.g., be deduced from the four corresponding beam former settings. An evaluation of the corresponding four sets of sound-characterizing data together with their corresponding directional information is preferred.

Figure 5:
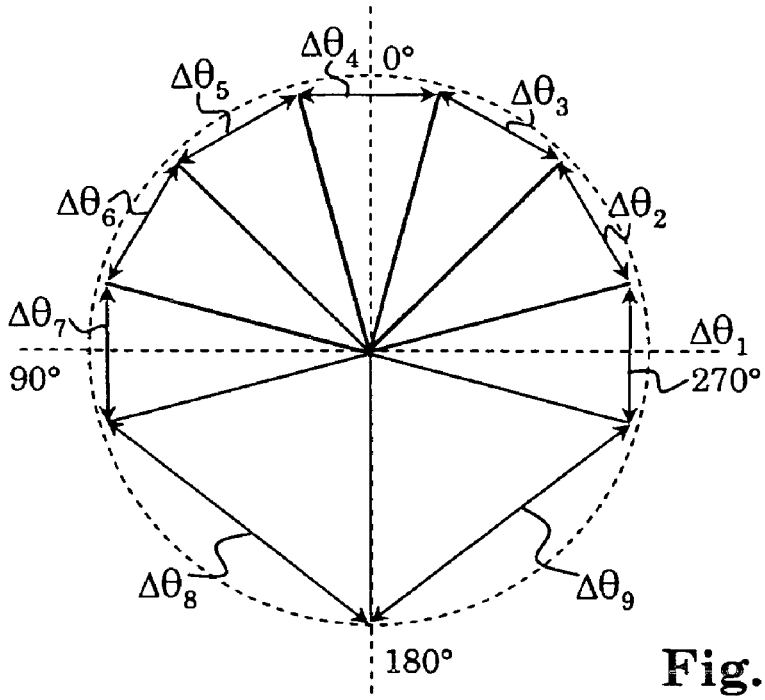
FIG. 5 a diagram indicating a possibility for sectioning space with a beam former.

Another possibility is, to control the beam former such that the acoustic environment is investigated in even more sections. FIG. 5 shows an example for that.

In FIG. 5, a schematic diagram indicating a possibility for sectioning space with a beam former is shown. The front hemisphere and the sides are investigated in 30°-spaced-apart sections (polar angle ranges) $\Delta\theta_1$ to $\Delta\theta_7$, the width of which may also be about 30°, or a little larger, so that they overlap stronger. The rest (of the back hemisphere) is investigated less precisely, since in most situations, a user looks approximately towards relevant sources of sound. In the example of FIG. 5, only two slice $\Delta\theta_8$ and $\Delta\theta_9$ are foreseen. It would, of course, also be possible to continue in the back hemisphere with finer slices.

An evaluation of the corresponding (at least) nine audio signals (together with corresponding directional information on each) will give rather deep insight into the location of sources of sound in the surroundings of the user. Accordingly, the transfer function can be adjusted in a way that very well suits the user's needs in that particular situation.

It is possible to realize embodiments as discussed in conjunction with FIGS. 3 and 5 in monaural hearing systems, i.e., when there is no communication between one hearing device of the hearing system and another (optional) hearing device of the hearing system. But it is easier to realize embodiments when a binaural hearing system is used, i.e., when one hearing device with at least one input transducer is foreseen for each ear of the user, which two hearing devices may exchange data (like audio signals and/or sound-characterizing data and/or directional information).

For optimizing beam former settings, it can be advantageous to introduce a data communication from the evaluating unit 50 to the beam former controller BFC1 (feedback; not shown in FIG. 3), i.e., the evaluating unit 50 can provide the beam former controller BFC1 with data for new beam former parameters, so that possibly an improved directional characteristic can be chosen.

Figure 6:
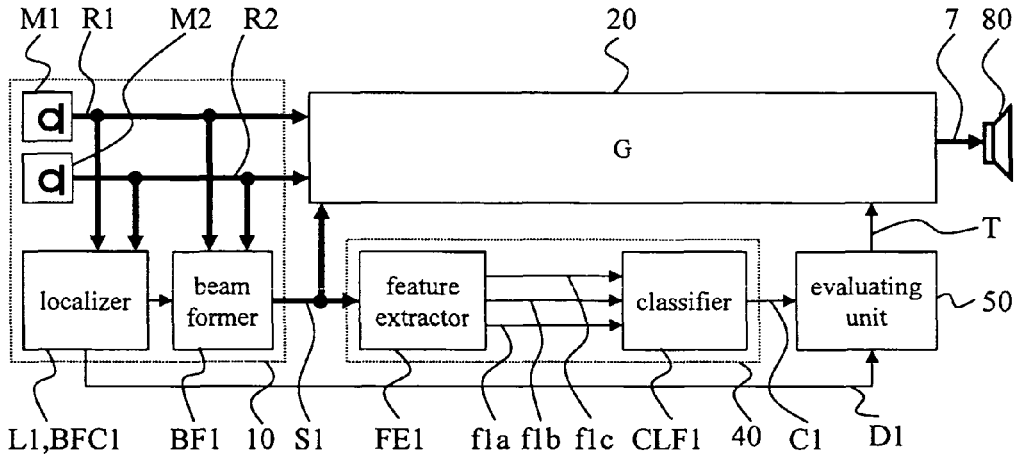
FIG. 6 a block diagram of a hearing system with beam former, localizer and classification.

FIG. 6 schematically shows a block diagram of a hearing system with a beam former, a localizer and with classification. This embodiment is similar to that one of FIG. 3, but the beam former controller BFC1 is realized by or comprised in a localizer L1. By means of the localizer L1, the directions of major sources of sound can be found, e.g., in a way known in the art, e.g., like in one of the above-mentioned publications WO 00/68703 A2 and EP 1326478 A2. The beam former controller BFC1 can control the beam former BF1 such, that it focuses into such a direction. It is also possible that the localizer L1 also derives the approximate angular width of a source of acoustic sound. In that case, it is possible to furthermore foresee that the beam former controller BFC1 controls the beam former BF1 accordingly, i.e., such, that the directional characteristic set by means of the beam former BF1 not only matches the direction, but also the angular width of the sound source detected by means of the localizer L1.

Figure 7:
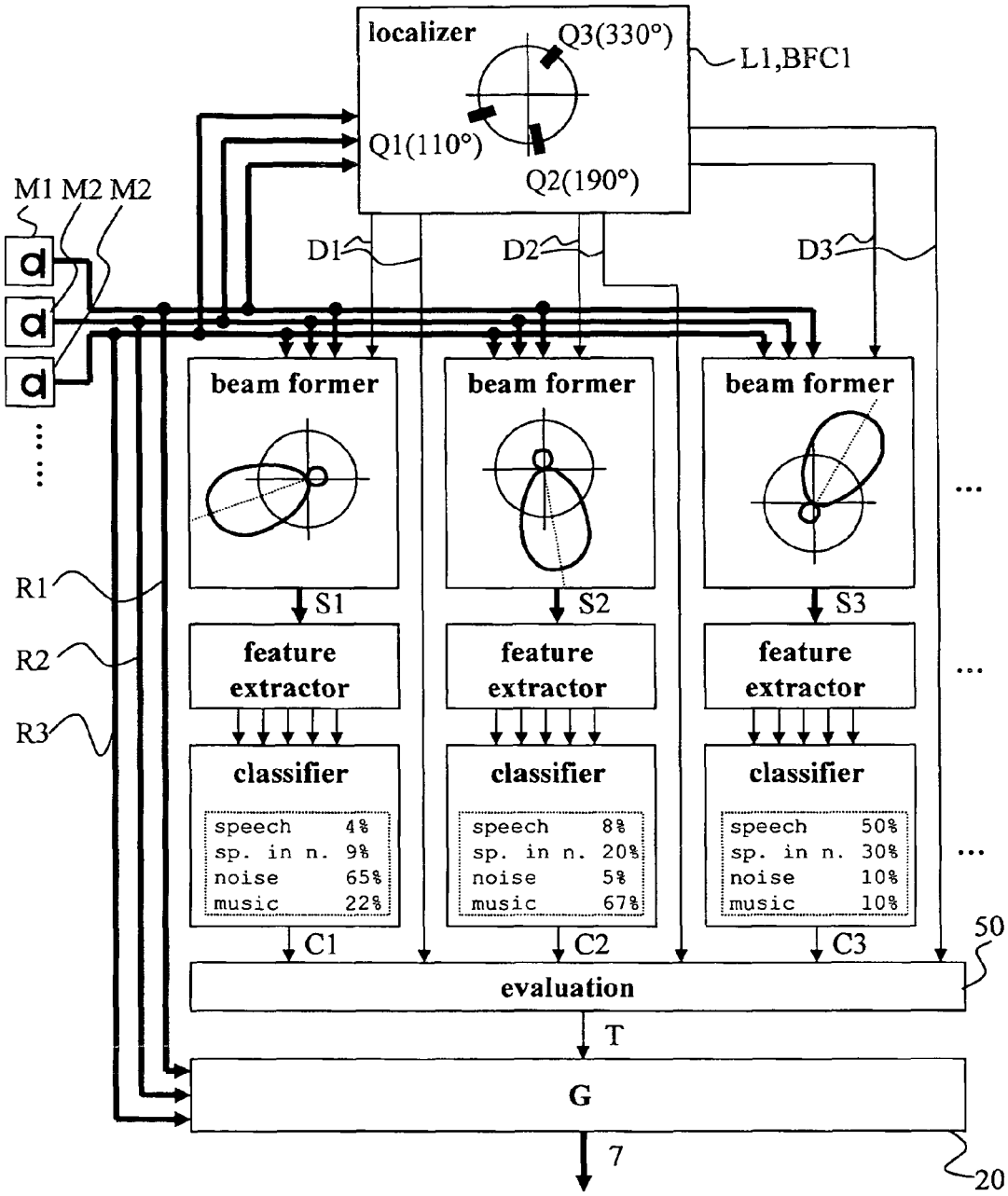
FIG. 7 a block diagram of a method of operating a hearing system with localizer, beam former and classification.

FIG. 7 schematically shows a block diagram of a method of operating a hearing system. Like the hearing system of FIG. 6, the hearing system of FIG. 7 comprises a localizer, which functions as a beam former controller, and sound characterization is done by classification. Three beam formers are depicted in FIG. 7; nevertheless, any number of beam formers, in particular 1, 2, 3, 4, 5 or 6 or more may be foreseen. If more than one beam former is provided for, the beam formers may work simultaneously, i.e., acoustic sound from different directions may be characterized at the same time. If, for one evaluation in the evaluation unit 50, more directional characteristics shall be used than beam formers are simultaneously available, the beam forming (and classifying) may take place successively (at least in part). In the following discussion of the example of FIG. 7, it will be assumed that three beam formers exist, which can work simultaneously.

In FIG. 7, three input transducers M1,M2,M3 are shown, but there may be two or four or more input transducers foreseen, which may be comprised in one hearing device, or which may be distributed among two hearing devices of the hearing system.

Example of FIG. 7

Raw audio signals R1,R2,R3 from the input transducers M1,M2,M3, respectively, (or from audio signals derived therefrom) are fed to the localizer L1. Therefrom, the localizer L1 derives that (in this example) three main sources of acoustic sound Q1,Q2,Q3 exist, which are located at polar angles of about 110°, 190° and 330°, respectively.

This information is fed to the evaluation unit 50 as directional informations D1,D2,D3 (or as a part of that), and one beam former each is instructed with information to focus into one of these preferred directions. Accordingly, first, second and third audio signals S1, S2 and S3, respectively, are generated such, that they preferably contain acoustic sound stemming from one of the main sources of acoustic sound Q1, Q2 and Q3, respectively. These audio signals S1, S2 and S3 are separately characterized, in this example by feature extraction and classifying.

In FIG. 7, the classes according to which an acoustic scene is classified, are speech, speech in noise, noise and music.

Each classification result (corresponding to sound-characterizing data) may comprise similarity values indicative of the likeness of the current acoustical scene and an acoustic scene represented by a certain class ("mixed-mode" classification), as shown in FIG. 7; or simply that one class is output, the corresponding acoustic scene of which is most similar to the current acoustic scene.

Thus, the link between the knowledge obtained from the localizer, that some sources of acoustic sound are present in the above-mentioned three main directions, and the findings, obtained from the characterizing units (feature extractors and classifiers), about what kind of sound source is apparently located in the respective direction, can be made in the evaluation unit 50. This way, the acoustic environment can be captured rather precisely.

Assuming that, when close to the straight-ahead direction ($\theta=0°$) a speaker (source of a speech signal) exists, the user prefers to understand that speech and wants other signals (like noise and music) to be fully or partially suppressed or muted, a transfer function G (or hearing program) accomplishing this task can be selected. In the current example, the transfer function G may use a beam former, which is adjusted such that acoustic sound impinging on the microphones from $\theta=110°$ is suppressed (has low amplification) as far as possible, while acoustic sound from $\theta=330°$ is emphasized (has stronger amplification), and acoustic sound from $\theta=190°$ is to some extent tolerated.

In this example, the resulting transfer function is possibly not strongly different from what is obtained from a simple classifier-beamformer approach, in which, without the evaluation according to the invention, it would be assumed that in a speech-in-noise situation—if a classification based on not or hardly focussed acoustic signals derives this classification result—the speaker is typically located near $\theta=0°$. In such a simple classifier-beamformer approach, a beam former might be used with a maximum amplification at $\theta=0°$, which probably would let through the speech and suppress the music (190°) well and would provide for some suppression of the noise (110°), too.

Figure 8:
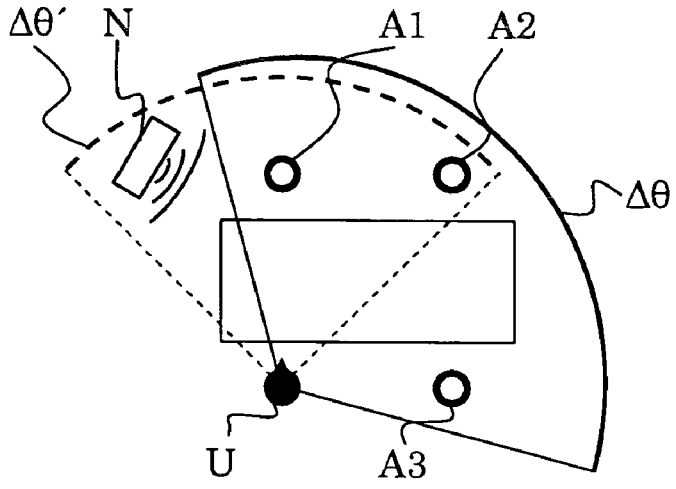
FIG. 8 an environmental situation and beam former opening angles realized by adapting the transfer function.
Figure 9:
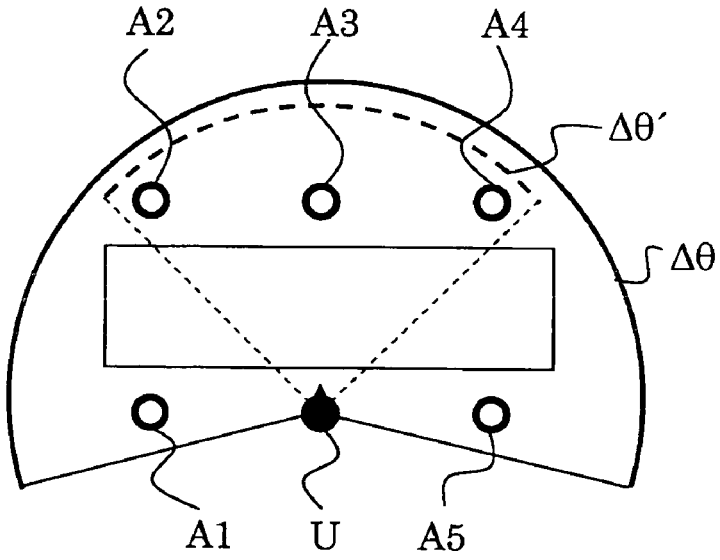
FIG. 9 an environmental situation and beam former opening angles realized by adapting the transfer function.

FIGS. 8 and 9 schematically show environmental situations (acoustic scenes) and beam former opening angles realized by adapting the transfer function G. FIG. 8 depicts a 4-person-at-a-table situation. The user U and three other persons (speakers) A1, A2, A3 talk to each other. A noise source, e.g., a radio or TV is present, too. Person A1 is the main speaker, so that the straight-ahead direction $\theta=0°$ points towards A1 (see the user's nose indicated in FIG. 8). According to the simple classifier-beamformer approach described above in conjunction with the example of FIG. 7, the transfer function would be adjusted such that A1 would be highlighted (i.e., A1 would be provided with an increased amplification), but A2 would be somewhat damped, and A3 would basically be muted. The noise source N would be only slightly damped. The corresponding beam former opening angle $\Delta\theta'$ is indicated by dashed lines in FIG. 8. Accordingly, the user U would hardly or not at all hear, when A3 would give comments, and the noise source would decrease the intelligibility of the speakers. That simple approach does obviously not give satisfying results.

By means of the invention, be it using a localizer or using section-wise environment sound investigation or others, it is probably possible to recognize that the three persons A1, A2, A3 exist, and approximately where they are located, and where the noise source N is located, so that the angular range depicted as $\Delta\theta$ (in solid lines) could be selected. Good noise suppression and good intelligibility of the speaker will be achieved.

FIG. 9 depicts a 6-person-at-a-table situation. The user U and five other persons (speakers) A1, . . . A5 talk to each other. The simple classifier-beamformer approach described above in conjunction with the example of FIG. 7 would basically prevent the user U from hearing comments from his neighbors A1 and A5 (see dashed lines, $\Delta\theta'$). By means of the invention, the existence and location of all persons would probably be recognizable, and satisfying transfer function settings (in form of values for transfer function parameters, in particular beam former parameters) could be selected (compare the beam former opening angle in solid lines, labelled $\Delta\theta$). Comments from A1 and A5 could be perceived by the user, without turning his head.

Figure 10:
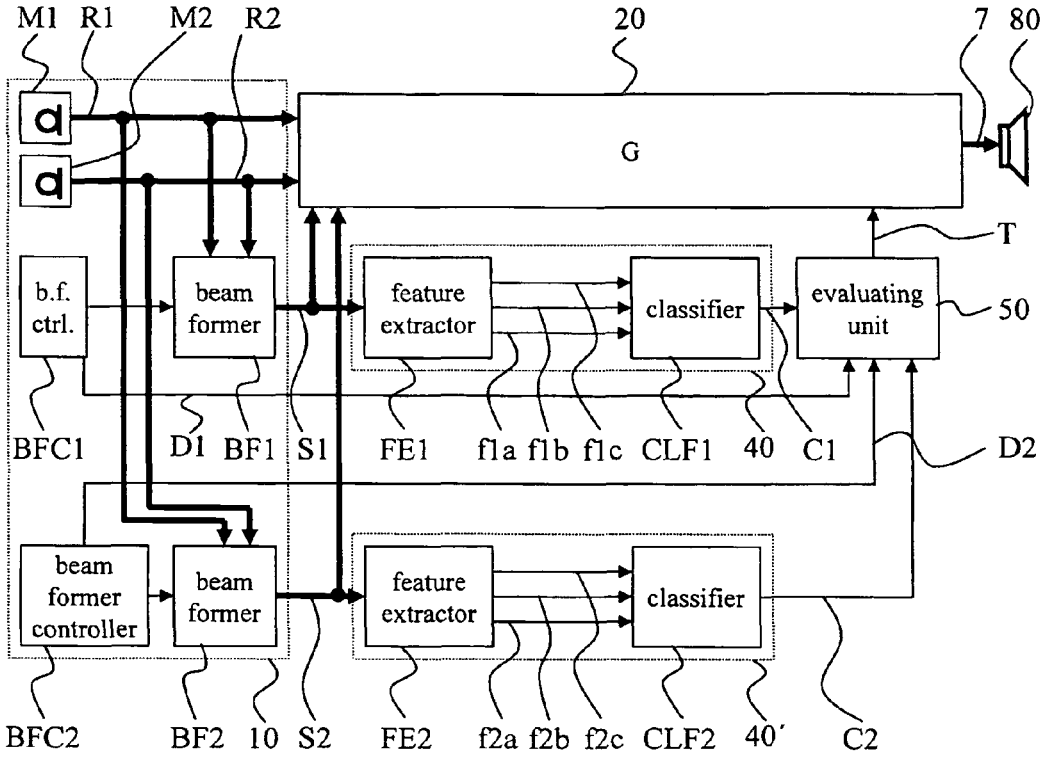
FIG. 10 a block diagram of a hearing system with two beam formers and two classifiers.

FIG. 10 shows an embodiment similar to the one of FIG. 3, but the input unit 10 comprises a second beam former BF2 with a second beam former controller BFC2, and a second feature extractor FE2 and a second classifier CLF2. The beam former controllers BFC1, BFC2 may be realized in form of localizers (confer, for example, also to FIGS. 6 and 7). As depicted, these additional parts BFC2, BF2, FE2 and CLF2 may work simultaneously with their counterparts. In the evaluation unit 50, C1 and D1 and C2 and D2 will be considered. It is possible to provide for further beam formers and characterizing units for parallel processing and time savings; it is even possible to adjust their number according to current needs, e.g., if a localizer is used, their number could match the number of sources of sound that are found.

And, as has already been described above, it is also possible to have, for determining the set of values T for transfer function parameters, only one beam former unit and one characterizing unit, which process audio signals obtained from acoustic sound, one after the other, with different directional characteristics.

The output unit 80 may have one or two output transducers (e.g., loudspeakers or implanted electrical-to-electrical or electrical-to-mechanical converters). If two output transducers are present, these will typically be fed with two different (partial) output audio signals 7.

Figure 11:
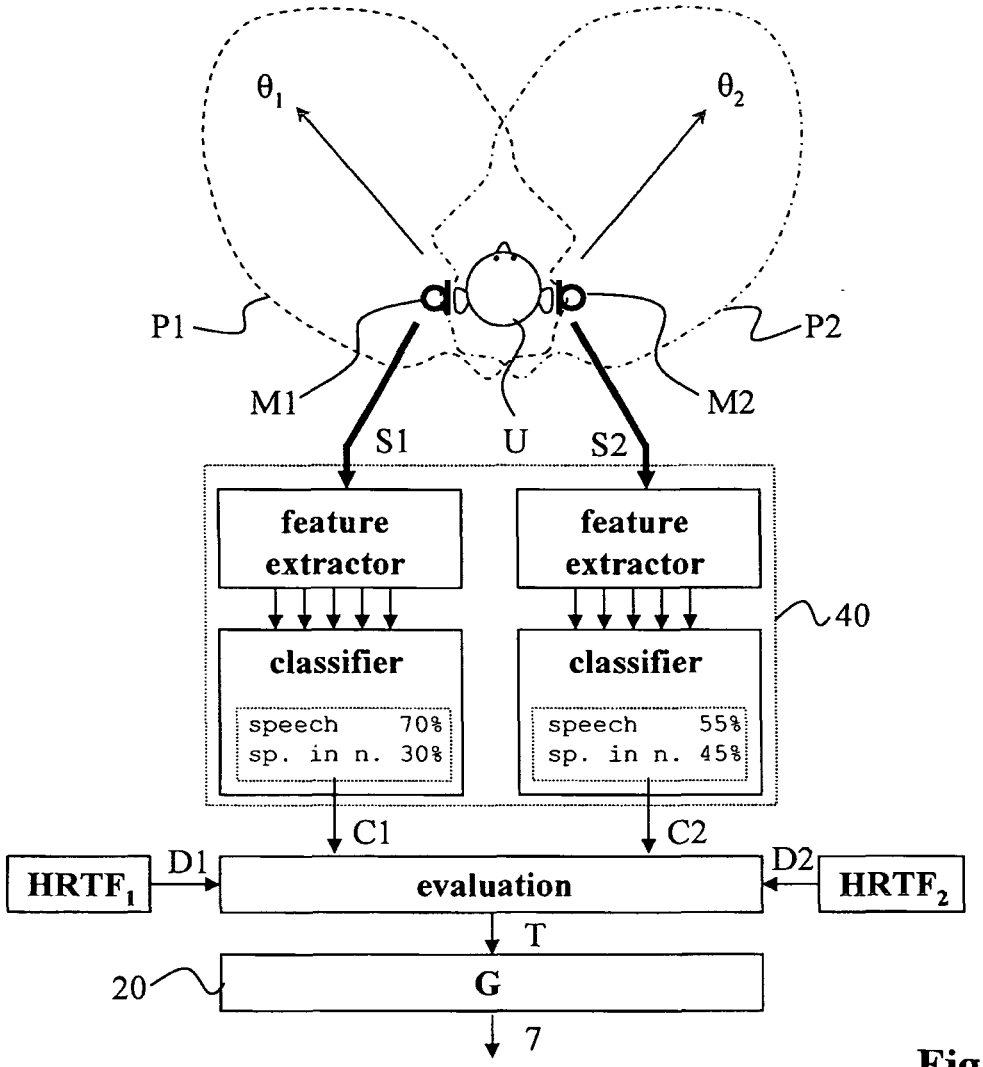
FIG. 11 a block diagram of a binaural hearing system with classification.

FIG. 11 shows schematically a block diagram of a binaural hearing system with classification. In this embodiment, each hearing device of the hearing system may have as little as only one input transducer (M1 and M2, respectively). The transducers M1 and M2 may, by themselves, have the same directional characteristic. Due to the fact, that the hearing devices (and therefore also the transducers M1 and M2), are worn on different sides of the user's head, the finally resulting directional characteristics P1 and P2 are different from each other. P1 and P2 are roughly sketched in FIG. 11. They may be obtained experimentally or from calculations. In calculations, HRTFs will usually be involved for modelling the so-called head shadow. Typically, directional characteristics P1 and P2 in an embodiment like shown in FIG. 11 have a maximum sensitivity somewhere between 30° and 600 off the straightforward direction. In FIG. 11, these directions are indicated as arrows labelled $\theta_1$ and $\theta_2$, respectively.

From signals S1 and S2, respectively, which are obtained from the input transducers M1 and M2, respectively, sets of features are extracted and classified. In FIG. 11 only two classes (speech and speech in noise) are depicted; usually 3, 4, 5, 6 or even more classes will be used.

Preferably, a "mixed-mode" classification (described above) is used. From the so-obtained similarity vectors (embodying sound-characterizing data C1,C2), in conjunction with directional information D1,D2, information about the location (direction) of the speech source and of the noise source may be derived. The directional information D1,D2 may comprise HRTF-information and/or information on the directional characteristics of the microphones M1,M2, preferably both (which would approximately correspond to experimentally determined directional characteristics when the hearing system is worn, at the user or at a dummy).

The evaluation may take place in one of the two hearing devices, in which case at least one of the sets C1,C2 of sound-characterizing data has to be transmitted from one hearing device to the other. Or the evaluation may take place in both hearing devices, in which case the sets C1,C2 of sound-characterizing data have to be interchanged between the two hearing devices. It would also be possible to do the feature extraction and classification in only one of the hearing devices, in which case the audio signals S1 or S2 have to be transmitted to from one hearing device to the other.

The transmission unit 20 and transfer function G may be realized in one or in both hearing devices, and it may process audio data for one or in both hearing devices. For example, the hearing system might be a cross-link hearing system, which picks-up acoustic sound on both sides of the head, but outputs sound only on one side. FIG. 11 may be interpreted that way.

Figure 12:
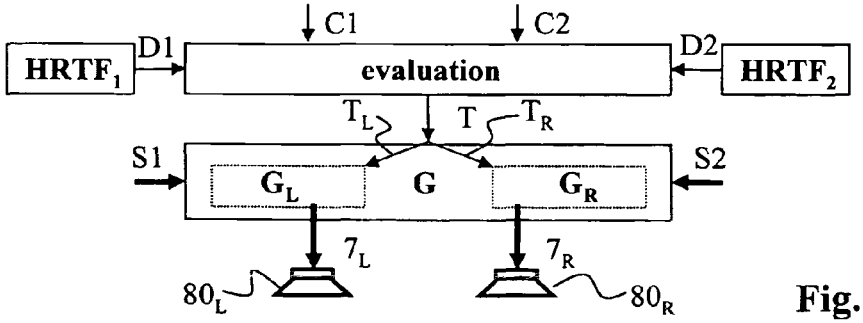
FIG. 12 a block-diagrammatical detail of a hearing system.

FIG. 12 schematically depicts the transmission unit 20 in more detail for a case, in which a "stereo" output of the hearing system is generated. FIG. 12 may, for such an embodiment, be understood as the lower part of FIG. 11. The set of values T for transfer function parameters may have two subsets $T_L$ and $T_R$ for the left and the right side, respectively, and the transfer function may comprise two partial transfer functions $G_L$ and $G_R$ for the left and the right side, respectively. From the audio signals S1 and S2, the partial output audio signals $\mathbf{7}_L$,$\mathbf{7}_R$ are obtained (via said (partial) transfer functions $G_L$ and $G_R$, which are fed to separate output transducers $\mathbf{80}_L$,$\mathbf{80}_R$ to be located at different sides of the user's head.

In a binaural system, it can be decided, whether the sound characterization and/or the evaluation and/or the transfer function processing shall take place in one or both of the hearing devices. Therefrom results the necessity to transmit input audio signals, sound-characterizing data, sets of values for transfer function parameters of (partial) transfer functions and/or (partial) output audio signals from one of the two hearing devices to the other.

Figure 13:
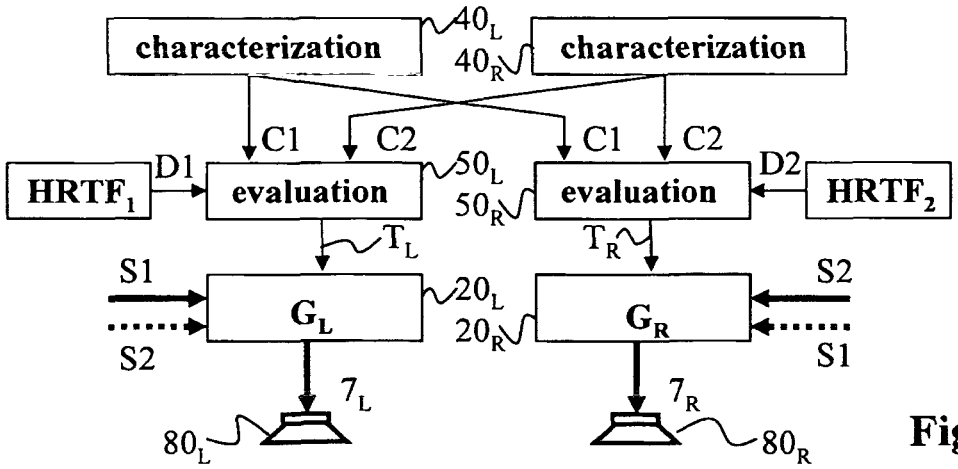
FIG. 13 a block-diagrammatical detail of a hearing system.

FIG. 13 is similar to FIG. 12 and schematically depicts the transmission unit 20 for a case, in which a "stereo" output of the hearing system is generated. FIG. 13 may, for such an embodiment, be understood as the lower part of FIG. 11, and it shall be illustrated that both hearing devices of the binaural hearing system may, in fact, have the same hardware and (in case of a digital hearing system) also (virtually) the same software (in particular: same algorithms for characterization and evaluation); yet, the hearing device should preferably "know", whether it is the "left" or the "right" hearing device. The left part of FIG. 13 depicts parts of the left hearing device, and the right part of FIG. 13 depicts parts of the right hearing device. Not only the characterizing unit 40 has one part $\mathbf{40}_L$, $\mathbf{40}_R$ on each side, also the evaluation unit 50 is distributed among the two hearing devices of the hearing system, having two separate (partial) evaluation units $\mathbf{50}_L$,$\mathbf{50}_R$. Also the transmission unit 20 is distributed among the two hearing devices of the hearing system, having two separate (partial) transmission units $\mathbf{20}_L$,$\mathbf{20}_R$. It is possible to process in the (partial) transmission unit $\mathbf{20}_L$ only the audio signals S1 and in the (partial) transmission unit $\mathbf{20}_R$ only the audio signals S2 (both depicted as solid arrows in FIG. 13). It is optionally possible to process in both (partial) transmission units $\mathbf{20}_L$,$\mathbf{20}_R$ both audio signals S1 and S2 (depicted as dashed arrows in FIG. 13).

Although the invention may be realized with only one input transducer with fixed directional characteristics per side in a binaural hearing system, it can be advantageous to provide for the possibility of obtaining (on one, or on each side) audio signals, with different directional characteristics. This can be realized by using input transducers with variable directional characteristics or by the provision of at least two input transducers (e.g., so as to realize a beam former).

In general, it has to be noted that throughout the text above, details of the transfer functions and their parameters have only been roughly discussed, because a major aspect of the invention is related to ways for obtaining values for transfer function paramters. Often, it will be advantageous to provide for a beam forming function within the transfer function. Such a beam former may use the same settings as a beam former, which is possibly used for deriving audio signals, which are to be characerized in order to derive sound-characterizing data for the evaluation unit. But different settings may be used as well. The same physical beam former may be used for both tasks, or different ones, and beam formers may be realized in form of software, so that various beam former software modules may run in parallel or successively for finding values for transfer function parameters and for the transfer function itself, i.e., for signal processing in the transmission unit.

In embodiments described above, at least one pair of data comprising sound-characterizing data and data comprising information on a directional characteristic with which the characterized audio signals have been obtained from acoustic sound, is evaluated, i.e., processed in an evaluating unit. The result of the evaluation can be used for adjusting a transfer function of the hearing system (e.g., for changing a hearing program).

LIST OF REFERENCE SYMBOLS

1 hearing system
6 incoming acoustic sound, acoustic waves
7 output audio signals
$\mathbf{7}_L$,$\mathbf{7}_R$ partial output audio signals
8 signals to be perceived by the user, outgoing acoustic sound
10 input unit
14 switch
20 transmission unit, processing unit, signal processor, digital signal processor
$\mathbf{20}_L$, $\mathbf{20}_R$ (partial) transmission unit, processing unit, signal processor, digital signal processor
40,40' characterizing unit
50 evaluating unit
$\mathbf{50}_L$,$\mathbf{50}_R$ (partial) evaluating unit
60 storage unit, memory
80 output unit, output transducer, loudspeaker
$\mathbf{80}_L$,$\mathbf{80}_R$ partial output unit, output transducer, loudspeaker
A1 . . . A5 persons, speakers
BF1,BF2 beam former unit, beam former
BFC1,BFC2 beam former controller
C1,C2 set of sound-characterizing data
CLF1,CLF2 classifier
D1,D2 directional information
f1*a*,f1*b*,f1*c*,f2*a*,f2*b*,f2*c* features
FE1,FE2 feature extractor
G transfer function $G_L$,$G_R$ partial transfer function
L1 localizer
M1,M2 input transducer, mechanical-to-electrical converter, acoustical-electrical converter, microphone
N source of noise
P1,P2 directional characteristics
R1,R2 raw audio signals; input audio signals
Q1,Q2,Q3 source of sound
S1 first audio signals; input audio signals
S2 second audio signals; input audio signals
T value, values, set of values
$T_L$,$T_R$ value, values, subset of values
U user of the hearing system
$\Delta\theta_1 \ldots \Delta\theta_9$ angular range, polar angle sections
$\Delta\theta$,$\Delta\theta'$ angular range, beam former opening angle
$\theta$ polar angle

The invention claimed is:

1. Method for operating a hearing system comprising an input unit, an output unit, a characterizing unit operationally connected to said input unit and a transmission unit operationally interconnecting said input unit and said output unit, said transmission unit implementing a transfer function which describes, how audio signals generated by said input unit are processed in order to derive audio signals fed to said output unit, and which can be adjusted by one or more transfer function parameters, said method comprising the steps of a1) obtaining, by means of a first beam former in said input unit and with a first directional characteristic of said input unit due to the first beam former having the first directional characteristic, first audio signals from incoming acoustic sound;

a2) obtaining, by means of a second beam former in said input unit and with a second directional characteristic of said input unit due to the second beam former having the second directional characteristic, which is different from said first directional characteristic, second audio signals from incoming acoustic sound;

b1) deriving from said first audio signals, by means of said characterizing unit, a first set of sound-characterizing data characterizing the first audio signals, which are obtained by means of the first beam former, as at least one of speech, noise, speech in noise, and music;

b2) deriving from said second audio signals a second set of sound-characterizing data characterizing the second audio signals, which are obtained by means of the second beam former, as at least one of speech, noise, speech in noise, and music;

c) deriving a value for each of at least one of said transfer function parameters in dependence of first directional information, which is data comprising information on said first directional characteristic, said first set of sound-characterizing data, second directional information, which is data comprising information on said second directional characteristic, and of said second set of sound-characterizing data, by evaluating each of the first directional information, the first set of sound-characterizing data characterizing the first audio signals, the second directional information, and the second set of sound-characterizing data characterizing the second audio signals, wherein steps b1) and b2) together comprise simultaneously classifying incoming acoustic sound incoming from a first direction with respect to an ear as at least one of speech, noise, speech in noise, and music, while differently classifying other incoming acoustic sound incoming from a second direction with respect to said ear as at least one of speech, noise, speech in noise, and music.

2. Method according to claim 1, wherein said input unit comprises a first input transducer, a second input transducer and the first beam former, the method furthermore comprising the steps of d1) feeding first raw audio signals derived from said first input transducer to said first beam former;

d2) feeding second raw audio signals derived from said second input transducer to said first beam former;

e1) processing said first and second raw audio signals in said first beam former, such as to set said first directional characteristic and to derive said first audio signals.

3. Method according to claim 2, wherein said input unit furthermore comprises at least a first localizer unit, the method furthermore comprising the steps of f1) feeding said first raw audio signals to said at least one first localizer unit;

f2) feeding said second raw audio signals to said at least one first localizer unit;

g1) processing said first and second raw audio signals in said at least one localizer unit, such as to derive data, referred to as localizing data, which are comprised in said first directional information;

h1) controlling said first beam former in dependence of said localizing data.

4. Method according to claim 1, wherein step b1) comprises the steps of i1) extracting a first set of features from said first audio signals; and j1) classifying said first set of features according to a set of classes, the result of said classification being comprised in said first set of sound-characterizing data.

5. Method according to claim 4, wherein said first audio signals are derived from a current acoustic scene, and wherein said result of said classification comprises, for at least one of said classes, data indicative of the similarity of said current acoustic scene and an acoustic scene of which the respective class is representative.

6. Method according to claim 1, wherein steps a1) and a2) take place simultaneously or successively.

7. Method according to claim 1, wherein said hearing system comprises a first and a second hearing device, which are operationally connected to each other and which are to be worn in or near the left and the right ear, respectively, of a user of the hearing system, both hearing devices comprising at least one input transducer each, and wherein at least one of said first and said second directional information comprises information derived from a head-related transfer function.

8. Method according to claim 6, wherein said hearing system comprises a first and a second hearing device, which are operationally connected to each other and which are to be worn in or near the left and the right ear, respectively, of a user of the hearing system, both hearing devices comprising at least one input transducer each, and wherein at least one of said first and said second directional information comprises information derived from a head-related transfer function.

9. Method according to claim 1, wherein said derived value constitute a set of values indicative of an acoustic scene.

10. Method according to claim 1, wherein the hearing system performs mixed-mode classification of the incoming acoustic sound by calculating similarity values as the first set of sound-characterizing data, wherein each one of the similarity values indicates a likeness of the incoming acoustic sound to a respective one of speech, noise, speech in noise, and music.

11. Method according to claim 1, wherein the first directional characteristic of the first beam former matches both of a spatial direction and an angular width of the incoming acoustic sound incoming from the first direction with respect to said ear.

12. Hearing system comprising an input unit comprising a first beam former having a first directional characteristic for obtaining, with the first directional characteristic of said first beam former, first audio signals from incoming acoustic sound, wherein the input unit further comprises a second beam former having a second directional characteristic, which is different from said first directional characteristic, for obtaining, with the second directional characteristic of said second beam former, second audio signals from incoming acoustic sound;

an output unit for receiving output audio signals and transducing these into signals to be perceived by a user of the hearing system;

a transmission unit, which is operationally interconnecting said input unit and said output unit, and which implements a transfer function, which can be adjusted by one or more transfer function parameters and which describes, how audio signals generated by said input unit are processed in order to derive said output audio signals;

a characterizing unit for deriving from said first audio signals a first set of sound-characterizing data characterizing the first audio signals, which are obtained via the first beam former, as at least one of speech, noise, speech in noise, and music, and deriving from said second audio signals a second set of sound-characterizing data characterizing the second audio signals, which are obtained via the second beam former, as at least one of speech, noise, speech in noise, and music;

an evaluating unit for deriving a value for each of at least one of said transfer function parameters, in dependence of said first set of sound-characterizing data, first directional information, which is data comprising information on said first directional characteristic, said second set of sound-characterizing data, and of second directional information, which is data comprising information on said second directional characteristic, by evaluating each of the first directional information, the first set of sound-characterizing data characterizing the first audio signals, the second directional information, and the second set of sound-characterizing data characterizing the second audio signals, wherein the hearing system simultaneously classifies incoming acoustic sound incoming from a first direction with respect to an ear as at least one of speech, noise, speech in noise, and music, while differently classifying other incoming acoustic sound incoming from a second direction with respect to said ear as at least one of speech, noise, speech in noise, and music.

13. Hearing system according to claim 12, furthermore comprising a storage unit containing data derived from at least one of a head-related transfer function and data related to a directional characteristic of at least one first input transducer of said input unit, and wherein said first directional information is at least in part derived from said storage unit.

14. Hearing system according to claim 12, wherein said input unit comprises a first input transducer, a second input transducer and the first beam former, which is operationally connected to said first and second input transducers, and a beam former controller for controlling said first beam former, wherein said first directional information is at least in part derived from said beam former controller.

15. Hearing system according to claim 14, wherein said input unit comprises a localizer operationally connected to said first and second input transducers, for determining the location of sources of sound and for providing said beam former controller with data related to said location of sources of sound.

16. Hearing system according to claim 12, wherein said characterizing unit comprises at least one feature extractor for extracting a first set of features from said first audio signals and at least one classifier for classifying said first set of features according to a set of classes, the result of said classification being comprised in said first set of sound-characterizing data.

17. Hearing system according to claim 12, which is a hearing-aid system comprising at least one hearing-aid device.

18. Method according to claim 12, wherein the hearing system performs mixed-mode classification of the incoming acoustic sound by calculating similarity values as the first set of sound-characterizing data, wherein each one of the similarity values indicates a likeness of the incoming acoustic sound to a respective one of speech, noise, speech in noise, and music.

19. Hearing system according to claim 12, wherein the first directional characteristic of the first beam former matches both of a spatial direction and an angular width of the incoming acoustic sound incoming from the first direction with respect to said ear.

20. Method for deriving information on an acoustic scene, comprising the steps of p1) obtaining, with a first directional characteristic, first audio signals from incoming acoustic sound from said acoustic scene, wherein the first audio signals are obtained using a beam former having the first directional characteristic;

p2) obtaining, with a second directional characteristic, which is different from said first directional characteristic, second audio signals from incoming acoustic sound from said acoustic scene, wherein the second audio signals are obtained using said or another beam former having the second directional characteristic;

q1) deriving from said first audio signals a first set of sound-characterizing data characterizing the first audio signals, which are obtained using the beam former having the first directional characteristic, as at least one of speech, noise, speech in noise, and music;

q2) deriving from said second audio signals a second set of sound-characterizing data characterizing the second audio signals, which are obtained using said or the another beam former having the second directional characteristic, as at least one of speech, noise, speech in noise, and music;

r) deriving said information on said acoustic scene in dependence of first directional information, which is data comprising information on said first directional characteristic, said first set of sound-characterizing data, second directional information, which is data comprising information on said second directional characteristic, and of said second set of sound-characterizing data by evaluating each of the first directional information, the first set of sound-characterizing data characterizing the first audio signals, the second directional information, and the second set of sound-characterizing data characterizing the second audio signals, wherein steps q1) and q2) are performed simultaneously such that incoming acoustic sound incoming from a first direction with respect to an ear is classified as at least one of speech, noise, speech in noise, and music, while other incoming acoustic sound incoming from a second direction with respect to said ear is simultaneously differently classified as at least one of speech, noise, speech in noise, and music.

21. Use of the method according to claim 20 in a hearing system.

22. Method according to claim 20, wherein steps q1) and q2) include performing mixed-mode classification of the incoming acoustic sound by calculating similarity values as the first set of sound-characterizing data and further similarity values as the second set of sound-characterizing data, wherein each one of the similarity values and each one of the further similarity values indicates a likeness of the incoming acoustic sound to a respective one of speech, noise, speech in noise, and music.

23. Method according to claim 20, wherein the first directional characteristic and the second directional characteristic match both of a spatial direction and an angular width of respective incoming acoustic sound incoming from the first direction with respect to said ear and the second direction with respect to said ear.

24. Method for manufacturing signals to be perceived by a user of a hearing system comprising an input unit, an output unit, a characterizing unit operationally connected to said input unit and a transmission unit operationally interconnecting said input unit and said output unit, said transmission unit implementing a transfer function which describes, how audio signals generated by said input unit are processed in order to derive audio signals fed to said output unit, and which can be adjusted by one or more transfer function parameters, said method comprising the steps of s1) obtaining, by means of a first beam former in said input unit and with a first directional characteristic of said input unit due to the first beam former having the first directional characteristic, first audio signals from incoming acoustic sound;

s2) obtaining, by means of a second beam former in said input unit and with a second directional characteristic of said input unit due to the second beam former having the second directional characteristic, which is different from said first directional characteristic, second audio signals from incoming acoustic sound;

t1) deriving from said first audio signals, by means of said characterizing unit, a first set of sound-characterizing data characterizing the first audio signals, which are obtained by means of the first beam former, as at least one of speech, noise, speech in noise, and music;

t2) deriving from said second audio signals a second set of sound-characterizing data characterizing the second audio signals, which are obtained by means of the second beam former, as at least one of speech, noise, speech in noise, and music;

u) deriving a value for each of at least one of said transfer function parameters in dependence of first directional information, which is data comprising information on said first directional characteristic, said first set of sound-characterizing data, second directional information, which is data comprising information on said second directional characteristic, and of said second set of sound-characterizing data, by evaluating each of the first directional information, the first set of sound-characterizing data characterizing the first audio signals, the second directional information, and the second set of sound-characterizing data characterizing the second audio signals;

v) obtaining output audio signals by processing audio signals generated by said input unit according to said transfer function using said derived value or values;

w) transducing said output audio signals into said signals to be perceived by a user of the hearing system, wherein steps t1) and t2) together comprise simultaneously classifying incoming acoustic sound incoming from a first direction with respect to an ear as at least one of speech, noise, speech in noise, and music, while differently classifying other incoming acoustic sound incoming from a second direction with respect to said ear as at least one of speech, noise, speech in noise, and music.

25. Method according to claim 24, wherein the hearing system performs mixed-mode classification of the incoming acoustic sound by calculating similarity values as the first set of sound-characterizing data, wherein each one of the similarity values indicates a likeness of the incoming acoustic sound to a respective one of speech, noise, speech in noise, and music.

26. Method according to claim 24, wherein the first directional characteristic of the first beam former matches both of a spatial direction and an angular width of the incoming acoustic sound incoming from the first direction with respect to said ear.

* * * * *

UNITED STATES PATENT AND TRADEMARK OFFICE

CERTIFICATE OF CORRECTION

PATENT NO. : 8,249,284 B2
APPLICATION NO. : 11/459185
DATED : August 21, 2012
INVENTOR(S) : Sylvia Allegro-Baumann et al.

It is certified that error appears in the above-identified patent and that said Letters Patent is hereby corrected as shown below:

In the Specifications:

In column 14, line 58, delete "600" and insert --60--

Signed and Sealed this
Fourth Day of June, 2013

Teresa Stanek Rea
*Acting Director of the United States Patent and Trademark Office*